US007677161B2

(12) United States Patent
Matsuo et al.

(10) Patent No.: US 7,677,161 B2
(45) **Date of Patent: *Mar. 16, 2010**

(54) STEAM OVEN

(75) Inventors: Hiroshi Matsuo, Tsurugashima (JP); Hiroyuki Hozumi, Mitaka (JP); Yoichi Kurita, Mitaka (JP)

(73) Assignees: Fujimak Corporation, Tokyo (JP); Extein Corporation, Tsurugashima (JP); Jamco Corporation, Tokyo (JP)

( * ) Notice: Subject to any disclaimer, the term of this patent is extended or adjusted under 35 U.S.C. 154(b) by 865 days.

This patent is subject to a terminal disclaimer.

(21) Appl. No.: 11/348,539

(22) Filed: Feb. 6, 2006

(65) Prior Publication Data

US 2006/0207440 A1 Sep. 21, 2006

Related U.S. Application Data

(63) Continuation of application No. PCT/JP03/09882, filed on Aug. 4, 2003.

(51) Int. Cl.
*A23L 1/00* (2006.01)

(52) U.S. Cl. ..... 99/330; 99/476; 219/400; 219/401; 219/681; 219/682

(58) Field of Classification Search ..... 99/327–333, 99/337–340, 483, 372–379, 403–418, 444–450, 99/467–479, 330, 451, DIG. 14; 219/400, 219/401, 681, 682; 126/20, 21 A; 239/461, 239/504, 498–500

See application file for complete search history.

(56) References Cited

U.S. PATENT DOCUMENTS

| | | | | |
|---|---|---|---|---|
| 5,768,982 | A * | 6/1998 | Violi et al. | 99/476 |
| 5,928,541 | A * | 7/1999 | Tsukamoto et al. | 219/400 |
| 6,188,045 | B1 * | 2/2001 | Hansen et al. | 219/401 |
| 6,318,246 | B2 * | 11/2001 | Fukushima et al. | 99/330 |

FOREIGN PATENT DOCUMENTS

| | | | |
|---|---|---|---|
| EP | 1 215 444 | A1 | 6/2002 |
| EP | 1 239 229 | A1 | 9/2002 |
| JP | 6-2852 | A | 1/1994 |
| JP | 8-178298 | A | 7/1996 |
| JP | 9-72545 | A | 3/1997 |
| JP | 11-108361 | A | 4/1999 |
| JP | 2001-304555 | A | 10/2001 |
| JP | 2003-50015 | A | 2/2003 |
| JP | 2003-227612 | A | 8/2003 |

* cited by examiner

*Primary Examiner*—Timothy F. Simone
(74) *Attorney, Agent, or Firm*—Cohen Pontani Lieberman & Pavane LLP

(57) ABSTRACT

There is provided a highly safe steam oven capable of controlling the amount of steam generated appropriately. Water dripped from a water feeder to the inside of a cooking chamber is converted into steam by a heater in the cooking chamber. The thus generated steam in the cooking chamber is discharged through a steam channel which keeps the inside of the cooking chamber connected to the outside of the steam oven. The temperature of steam passing through the steam channel is measured by a steam temperature measuring device. The amount of water fed from the water feeder is controlled in response to the measured temperature.

20 Claims, 3 Drawing Sheets

STEAM OVEN

RELATED APPLICATIONS

This is a continuation of International Application No. PCT/JP2003/009882 filed on Aug. 4, 2003, the content of which is hereby incorporated by reference.

BACKGROUND OF THE INVENTION (i) Field of the Invention

The present invention relates to a steam oven, more specifically, a steam oven that humidifies food during its heating so as to prevent drying of the food or steams food.

(ii) Description of the Related Art

For example, a steam oven of this type is disclosed in U.S. Pat. No. 5,209,941. In this steam oven, water dripped to the inside of a cooking chamber is converted into mist by a fan, and the mist is then heated due to the high temperature inside the cooking chamber, whereby steam is generated. The inside of the cooking chamber and the outside of the oven are connected to each other by a channel. At least during generation of the steam, a valve provided near the outlet of the channel is kept closed to seal the inside of the cooking chamber. The amount of steam generated inside the cooking chamber can be controlled by adjusting the amount of water dripped to the inside of the cooking chamber, in response to the pressure inside the cooking chamber. The pressure inside the cooking chamber is relatively high. Therefore, water feeding by the channel must be conducted forcibly by a pump or the like.

In this steam oven, a pressure sensor is provided in the cooking chamber so as to control the amount of steam generated in the cooking chamber. When the pressure inside the cooking chamber measured by the pressure sensor becomes lower than a predetermined pressure, the amount of steam is increased by dripping water, while when it becomes higher than the predetermined pressure, the amount of steam is decreased by decreasing the amount of dripping water.

As is obvious from the above description, this conventional steam oven has a problem that it cannot control the amount of steam generated appropriately, because it controls the amount of steam generated in response to the pressure inside the cooking chamber. Further, the conventional oven also has a problem that it lacks safety because the cooking chamber is sealed during cooking of food and the pressure inside the cooking chamber becomes high accordingly.

The present invention has been conceived to solve the above problems of the prior art. An object of the present invention is to provide a steam oven which is capable of controlling the amount of steam generated appropriately in response to the steam temperature. Another object of the present invention is to provide a steam oven which is rendered highly safe by keeping a cooking chamber connected to the outside of the oven so as to prevent the inside of the cooking chamber from being exposed to high pressure.

SUMMARY OF THE INVENTION

According to one aspect of the present invention, the steam oven of the present invention comprises:

a water feeder, an agitator, a heater, a steam channel, a steam temperature measuring device, and a feedwater controlling device, wherein the water feeder feeds water into a cooking chamber, the agitator agitates air in the cooking chamber, the heater heats the inside of the cooking chamber, the steam channel keeps the inside of the cooking chamber connected to the outside of the steam oven to discharge steam generated by the heater in the cooking chamber from the steam oven, the steam temperature measuring device measures the temperature of steam passing through the steam channel, and the feedwater controlling device controls the amount of water fed from the water feeder in response to the temperature measured by the steam temperature measuring device.

According to one embodiment of the present invention, the water feeder drips water to the inside of the cooking chamber.

According to another embodiment of the present invention, water fed by the water feeder is dripped on or near the heater to be converted into steam by the heater and then diffused inside the cooking chamber by the agitator.

According to still another embodiment of the present invention, water fed by the water feeder is dripped on or near the agitator, blown out by the agitator in a mist form, converted into steam as passing by the heater, and diffused inside the cooking chamber.

According to still another embodiment of the present invention, the feedwater controlling device controls the amount of water dripped by the water feeder.

According to still another embodiment of the present invention, steam in the cooking chamber is discharged from the oven through the steam channel when the pressure inside the cooking chamber becomes higher than the pressure outside the oven.

According to still another embodiment of the present invention, the steam temperature measuring device is provided in the steam channel.

According to still another embodiment of the present invention, the steam channel has a steam trap for condensing steam, and the steam temperature measuring device is provided in the steam trap.

According to still another embodiment of the present invention, the steam temperature measuring device is provided in the vicinity of a steam outlet provided in the steam trap.

DETAILED DESCRIPTION OF THE PREFERRED EMBODIMENTS

Figure 1:
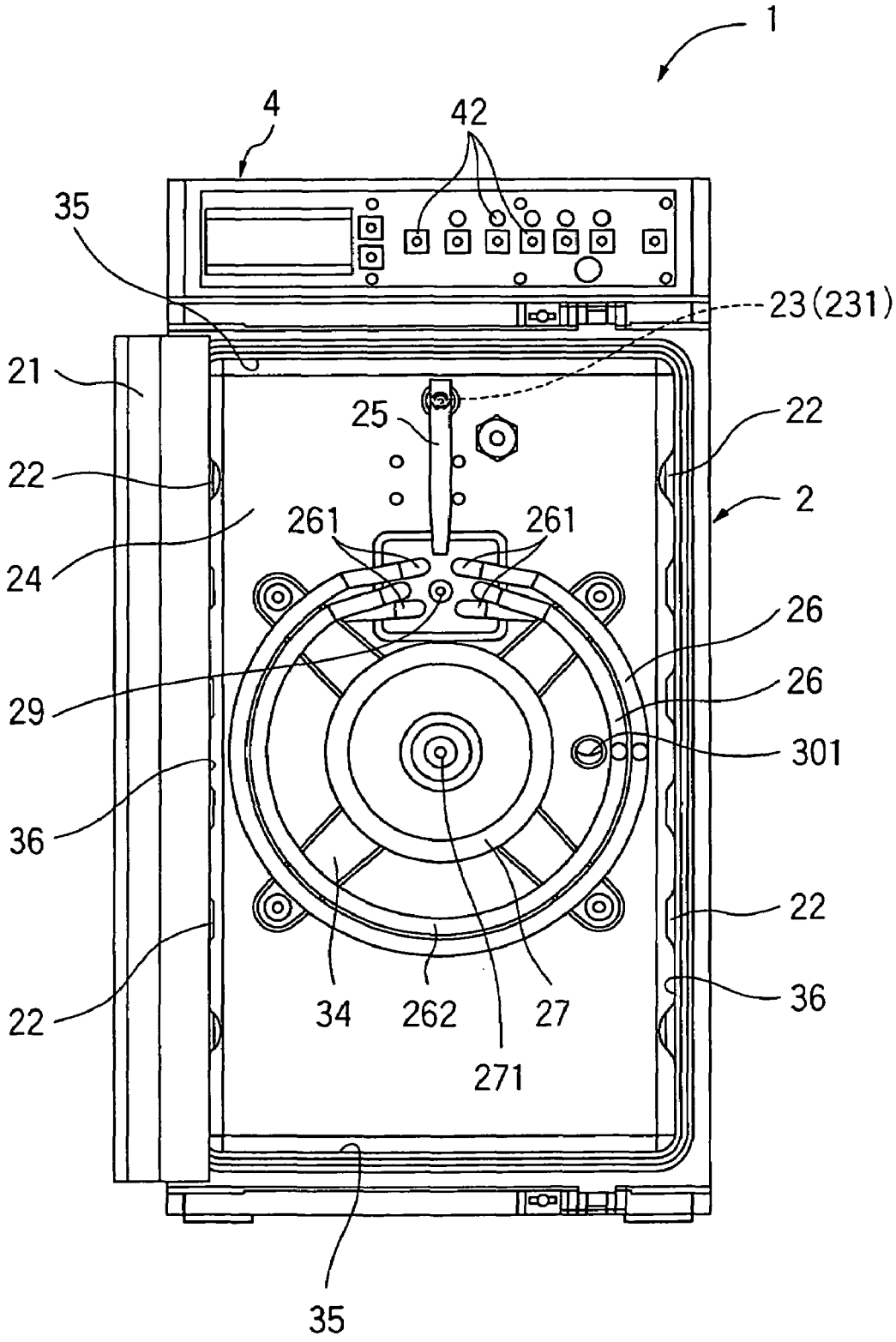
FIG. 1 is a front view of a steam oven according to the present invention.
Figure 2:
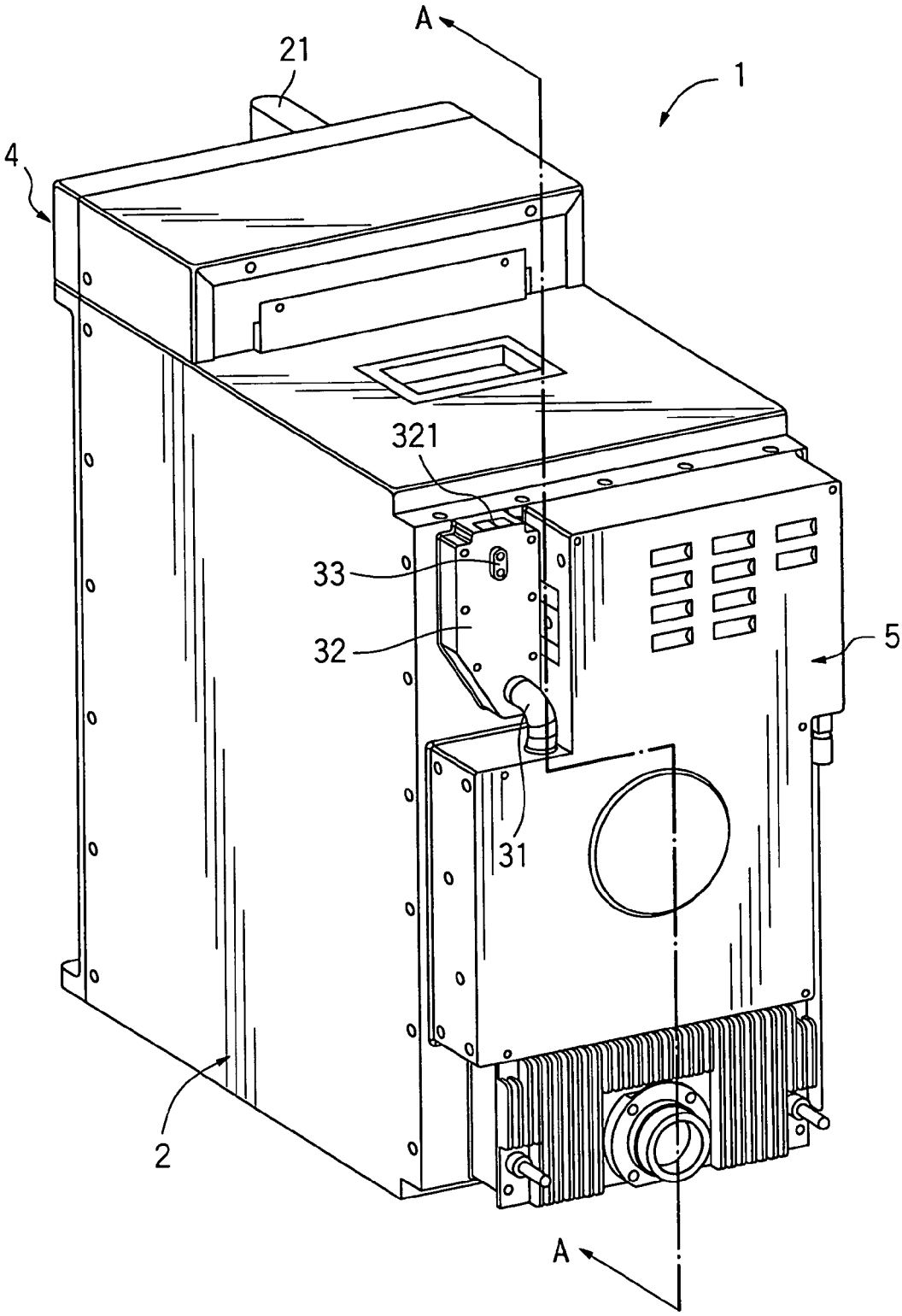
FIG. 2 is a rear perspective view of the steam oven of FIG. 1.
Figure 3:
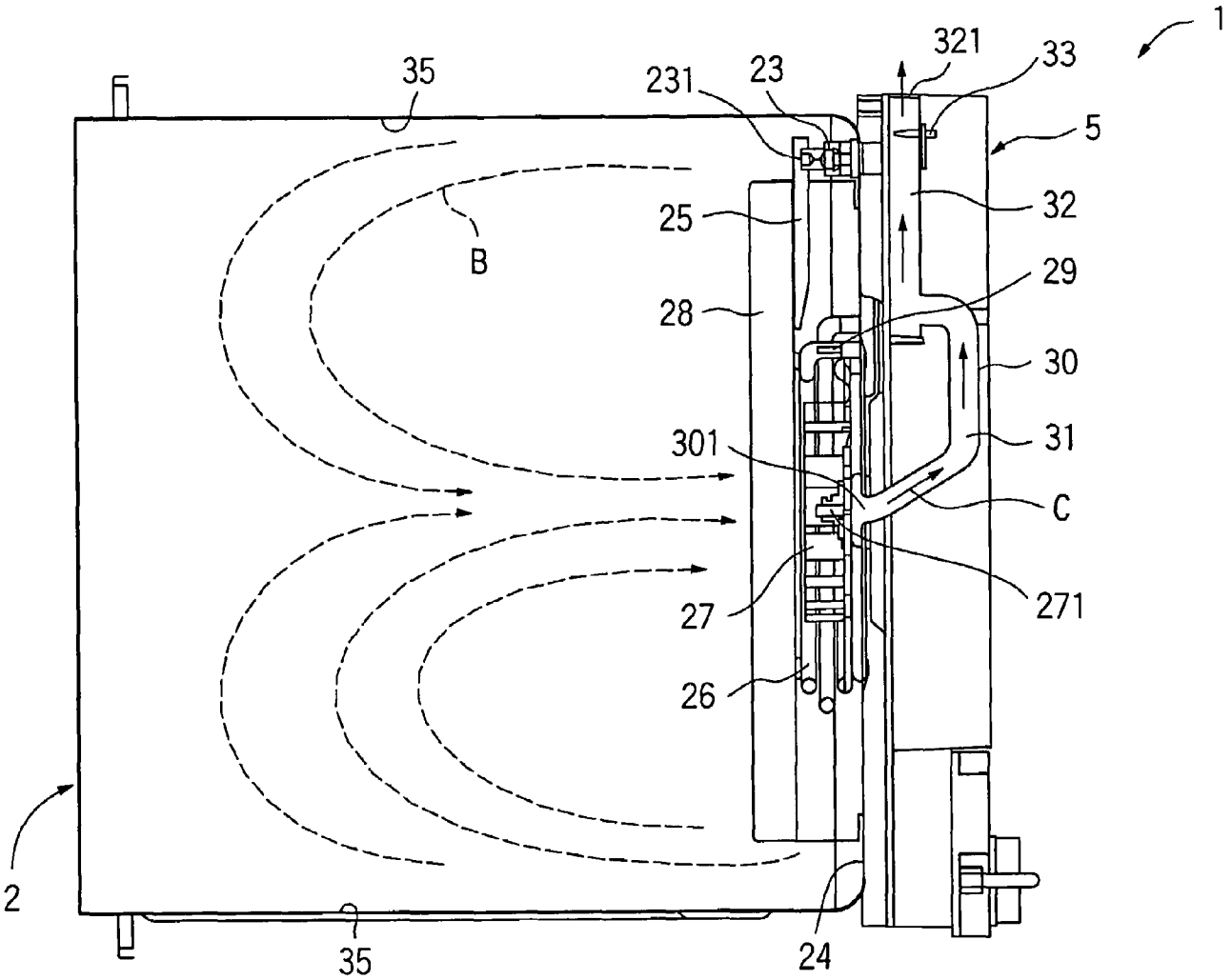
FIG. 3 is a schematic diagram showing a cross section at the line A-A of FIG. 2.

FIG. 1 shows a front view of a steam oven according to one embodiment of the present invention. FIG. 2 shows a rear perspective view of the steam oven. FIG. 3 shows a schematic view of a cross section at the line A-A of FIG. 2. For convenience of explanation, FIG. 1 shows the steam oven with a baffle plate (refer to 28 in FIG. 3) removed and a door 21 opened nearly at 90 degrees, and FIG. 2 also shows the steam oven with the door 21 opened nearly at 90 degrees.

As is obvious from FIG. 1 and FIG. 2, a steam oven 1 according to the present invention primarily comprises a cooking chamber 2 in which food (not shown) is placed and a control operation section 4 which is provided on the cooking chamber 2. On the back of the cooking chamber 2 is provided a box 5 for housing devices required to perform cooking, particularly heating or steaming, of food. These devices can be controlled by the control operation section 4. On the front of the control operation section 4 are provided a number of switches 42 which are required by an operator to operate the steam oven 1.

Food can be put in and taken out of the cooking chamber 2 freely through the door 21 which is provided on the front of the cooking chamber 2. On the left and right inner walls 36 of the cooking chamber 2, projections 22 which support food trays (not shown) are provided on multiple levels (6 levels in this case).

Next, each section will be further described, with reference primarily to FIGS. 1 and 3.

A feedwater nozzle 23 projects from the rear inner wall 24 of the cooking chamber 2 toward the inside of the chamber 2. The feedwater nozzle 23 guides water from the outside of the cooking chamber 2 to the inside thereof. Although the feedwater nozzle 23 penetrates the rear inner wall 24 of the cooking chamber 2, the inside and outside (back) of the cooking chamber 2 are separated from each other in a sealed state. The rear end (not shown) of the feedwater nozzle 23 is connected to a water supply source (not shown) provided outside the cooking chamber 2, e.g. an outlet of a water-filled tank or a faucet. Water from this supply source passes through the feedwater nozzle 23 and is ejected from the tip of the nozzle 23, i.e. an outlet 231, to the inside of the cooking chamber 2. The outlet 231 is positioned in the upper portion of the cooking chamber 2, more specifically, above oven heaters 26. The amount of water supplied through the feedwater nozzle 23 can be adjusted by, for example, opening or closing a valve provided in the feedwater nozzle 23 or a valve (not shown) provided at the outlet of the water-filled tank. The degree of opening and closing of these valves is controlled by the control operation section 4. Further, the internal pressure of the cooking chamber 2 in the present invention is kept relatively low, so that water can be supplied easily without using a pump or the like and by merely opening or closing the valve.

A dripping member 25 is situated in the vicinity of the outlet 231 of the feedwater nozzle. The dripping member 25 extends downward at nearly perpendicularly to the outlet 231. Water ejected from the outlet 231 collides with the dripping member 25 and is guided downward and dripped from the tip of the member 25 to the inside of the cooking chamber 2.

Two or more (in this case, two) annular oven heaters 26 which have different diameters are provided with some space between the rear inner wall 24 of the cooking chamber 2 and themselves. The oven heaters 26 not only heat the inside of the cooking chamber 2 but also convert water dripped from the dripping member 25 onto the oven heaters 26 into steam. In place of being dripped directly on the oven heaters 26, water may be dripped in the vicinity of the oven heaters 26 so as to be converted into steam. These oven heaters 26 are so shaped and positioned that water dripped from the dripping member 25 passes through space between the ends 261 of the oven heaters 26 and drops onto or near their lowermost portions 262. The ends 261 of the oven heaters 26 are connected to an electric supply source (not shown) provided outside the cooking chamber 2 (i.e. on the back of the chamber 2). Although these ends penetrate the rear inner wall 24 of the cooking chamber 2, the inside and outside (back) of the chamber 2 are separated from each other in a sealed state. Consequently, steam in the cooking chamber never leaks from these ends.

An annular fan 27 is situated nearly at the center of the cooking chamber 2 and surrounded by the oven heaters 26. The fan 27 is secured to the surface of the rear inner wall 24 by four support shafts 34. The fan 27 is driven by a motor (not shown) provided outside the cooking chamber 2 (i.e. on the back of the chamber 2) through a motor shaft 271 which penetrates the rear inner wall 24 of the cooking chamber 2. Although the motor shaft 271 penetrates the cooking chamber 2, the inside and outside (back) of the cooking chamber 2 are separated from each other in a sealed state. When the fan 27 is spun by the action of the motor, air taken in from the central portion of the fan is blown out by the action of blades disposed around the periphery of the fan. As a result, heat and steam of the oven heaters 26 disposed around the fan 27 are spread inside the cooking chamber. In place of dripping water on the oven heaters 26, water may be dripped on or near the fan 27 (which will be described later) to form into mist and then converted into steam by use of heat from the oven heaters 26. In this case, water in a mist form turns into steam when it passes by the oven heaters 26. Alternatively, a heat source other than the oven heaters 26 may be provided to generate steam by use of heat from this heat source.

As is obvious from FIG. 3, the front side of the fan 27 is fully covered by the baffle plate 28. The fan 27 can take in air through a number of air inlets (not shown) provided in the central portion of the baffle plate 28. Meanwhile, since air blown out by the fan 27 is blocked by the baffle plate 28, it is blown to the inside of the cooking chamber 2 from spaces between the baffle plate 28 and the upper and lower inner walls 35 and left and right inner walls 36 of the cooking chamber 2 as indicated by dashed arrows B in FIG. 3. By the action of the fan 27, air in the cooking chamber is agitated, and steam-containing hot air contacts all foods placed in the cooking chamber.

A cooking chamber temperature sensor 29 is situated in the space between the ends 261 of the oven heaters 26. The sensor 29 projects from the rear inner wall 24. The cooking chamber temperature sensor 29 is situated at a position where heat and steam from the fan 27 pass. The cooking chamber temperature sensor 29 measures the temperature inside the cooking chamber 2. The measured temperature is immediately sent to the control operation section 4. For example, when the temperature inside the cooking chamber 2 is abnormally high, the control operation section 4 can give a warning to an operator or turn off the steam oven automatically.

Between the oven heaters 26 and the fan 27, an inlet 301 of a steam channel 30 is opened to the inside of the cooking chamber 2. As indicated by arrows C in FIG. 3, steam generated in the cooking chamber 2 enters the inlet 301, passes through the steam channel 30 and is discharged to the outside of the steam oven 1. The steam channel 30 comprises a steam hose 31 which extends vertically upward and a steam trap 32 which is connected to the hose 31 nearly perpendicularly to the hose 31 and extends vertically upward. These inlet 301, steam hose 31 and steam trap 32 are kept opened. As a result, the inside of the cooking chamber and the outside of the oven are kept connected to each other, and the cooking chamber 2 is therefore kept opened to the outside air.

The appearances of the steam hose 31 and steam trap 32 are well illustrated in FIG. 2. The steam trap 32 is formed as a container having a larger capacity than the steam hose 31 and has a relatively small steam outlet 321 at its top. The steam trap 32 not only holds steam spewed out from the steam hose 31 temporarily to lower the speed of the steam but also brings the steam into indirect contact with the outside air in its wider area to condense the steam. The steam trap 32 decreases or moderates steam discharged from the steam outlet 321 to the outside of the oven. Therefore, according to the present invention, a highly safe oven can be provided.

A steam temperature sensor 33 is provided in the vicinity of the steam outlet 321 of the steam trap 32. The steam temperature sensor 33 measures the temperature of steam discharged from the steam outlet 321. The measured temperature is immediately sent to the control operation section 4. In response to the temperature, the control operation section 4 adjusts the degree of opening of the valve provided in the feedwater nozzle 23 or the valve (not shown) provided at the outlet of the water-filled tank so as to adjust the amount of water fed through the feedwater nozzle 23, i.e. the amount of water dripped to the inside of the cooking chamber. The steam temperature sensor 33 does not necessarily have to be provided in the vicinity of the steam outlet 321 and may be provided at other position on the steam trap 32 or may be provided on the steam hose 31. However, since steam to be discharged is the steadiest in the vicinity of the steam outlet 321, the steam temperature is preferably measured near the outlet 321 for the sake of accuracy.

The baffle plate 28 will be further described with reference to FIG. 3. The baffle plate 28 is rectangular and attached to and spaced-apart from the rear inner wall 24 of the cooking chamber 2 such that it covers a portion of the front of the dripping member 25 and the entire fronts of the oven heaters 26 and fan 27. Although an air inlet is provided in the central portion of the fan 27 as described above, no holes are particularly formed in other portions of the fan 27. By the presence of the baffle plate 28, the oven heaters 26 and other components can be protected from tarnish caused by food placed in the cooking chamber. The baffle plate 28 is slightly smaller than the rear inner wall 24 of the cooking chamber 2. The baffle plate 28 forms spaces between the periphery thereof and the upper and lower inner walls 35 and left and right inner walls 36 of the cooking chamber 2. Hot air generated by the fan 27 passes through the spaces.

Finally, the operation of the oven according to the present invention will be described briefly. First, water dripped from the dripping member 25 through the feedwater nozzle 23 is converted into steam by heat from the oven heaters 26. This steam fills the inside of the cooking chamber 2 by the fan 27. Then, when the steam inside the cooking chamber 2 reaches saturation, the steam passes through the inlet 301, the steam hose 31 and the steam trap 32 sequentially and is discharged from the steam outlet 321 to the outside of the oven 1 due to the difference in pressure between the inside of the cooking chamber and the outside of the oven. At that time, the temperature of the steam is measured by the steam temperature sensor 33 provided in the vicinity of the steam outlet 321. For example, when the temperature is too high, the amount of steam in the cooking chamber 2 can be controlled appropriately by adjusting the amount of water fed through the feedwater nozzle 23 (for example, by stopping dripping of the water).

In the above embodiment, although the amount of water dripped to the inside of the cooking chamber 2 is adjusted by changing the amount of water fed through the feedwater nozzle 23, the amount can also be adjusted by changing a time interval at which the water is dripped. Further, the steam hose 31 and the steam trap 32 do not necessarily have to be provided in the upper portion and may also be provided in the horizontal direction.

Further, the amount of steam generated can also be adjusted by changing the output of the oven heaters 26. In addition, the amount of steam generated can also be adjusted by opening or closing the steam outlet 321 of the steam trap 32 or the inlet 301 of the steam channel 30. However, even in the latter case, the outlet and the inlet 301 are not closed completely and are kept connected to the outside of the oven.

According to the present invention described above, the amount of steam in the cooking chamber can be controlled appropriately by controlling the amount of steam generated in response to the temperature of the steam. Further, since the pressure of steam inside the cooking chamber and the pressure of steam discharged from the steam outlet are kept relatively low by keeping the inside of the cooking chamber unsealed and connected to the outside of the oven, a highly safe steam oven can be provided. Further, in the steam oven of the present invention, water can be supplied without particularly using a pump, since the pressure inside the cooking chamber is low.

What is claimed is:

1. A steam oven comprising:

a cooking chamber, a feedwater nozzle extending into the cooking chamber to feed water into the cooking chamber from outside of the cooking chamber, a heater located in the cooking chamber and configured to convert the water into steam, an agitator configured to diffuse the steam inside the cooking chamber, a steam channel configured to communicate the cooking chamber to an outside of the steam oven and discharging steam generated by the heater from the steam oven, a steam temperature measuring device configured to measure temperature of the steam passing through the steam channel, and a feedwater controlling device configured to control an amount of water fed from the feedwater nozzle in response to the temperature measured by the steam temperature measuring device, wherein the feedwater nozzle feeds water on or near the heater in the cooking chamber.

2. The steam oven of claim 1, wherein the water feeder controlling device controls the amount of water dripped by the feedwater nozzle.

3. The steam oven of claim 2, wherein the steam temperature measuring device is provided in the steam channel.

4. The steam oven of claim 1, wherein steam in the cooking chamber is discharged from the oven through the steam channel when the pressure inside the cooking chamber becomes higher than the pressure outside the oven.

5. The steam oven of claim 4, wherein the steam temperature measuring device is provided in the steam channel.

6. The steam oven of claim 1, wherein steam in the cooking chamber is discharged from the oven through the steam channel when the pressure inside the cooking chamber becomes higher than the pressure outside the oven.

7. The steam oven of claim 6, wherein the steam temperature measuring device is provided in the steam channel.

8. The steam oven of claim 1, wherein the steam temperature measuring device is provided in the steam channel.

9. The steam oven of claim 1, wherein the steam temperature measuring device is provided in the steam channel.

10. The steam oven of claim 1, wherein the steam channel has a steam trap for condensing steam, and the steam temperature measuring device is provided in the steam trap.

11. The steam oven of claim 10, wherein the steam temperature measuring device is provided in the vicinity of a steam outlet provided in the steam trap.

12. The steam oven of claim 1, wherein water fed by the feedwater nozzle is dripped on or near the agitator, blown out by the agitator in a mist form, converted into steam as passing by the heater, and diffused inside the cooking chamber.

13. The steam oven of claim 12, wherein the feedwater controlling device controls the amount of water dripped by the feedwater nozzle.

14. The steam oven of claim 13, wherein the steam temperature measuring device is provided in the steam channel.

15. The steam oven of claim 12, wherein the steam temperature measuring device is provided in the steam channel.

16. The steam oven of claim 1, wherein the feedwater controlling device controls the amount of water dripped by the feedwater nozzle.

17. The steam oven of claim 16, wherein the steam temperature measuring device is provided in the steam channel.

18. The steam oven of claim 1, wherein steam in the cooking chamber is discharged from the oven through the steam channel when the pressure inside the cooking chamber becomes higher than the pressure outside the oven.

19. The steam oven of claim 18, wherein the steam temperature measuring device is provided in the steam channel.

20. The steam oven of claim 1, wherein the steam temperature measuring device is provided in the steam channel.

* * * * *